US008101841B2

(12) United States Patent
Hinrichs et al.

(10) Patent No.: US 8,101,841 B2
(45) Date of Patent: Jan. 24, 2012

(54) ONE-HANDED MUSICAL TRIANGLE

(75) Inventors: Douglas Hinrichs, Jersey City, NJ (US); Andrzej Krol, Wayne, NJ (US); Ray Enhoffer, Clifton, NJ (US); Richard Simons, Garfield, NJ (US)

(73) Assignee: KMC Music, Inc., Bloomfield, CT (US)

( * ) Notice: Subject to any disclaimer, the term of this patent is extended or adjusted under 35 U.S.C. 154(b) by 36 days.

(21) Appl. No.: 12/687,780

(22) Filed: Jan. 14, 2010

(65) Prior Publication Data

US 2011/0167981 A1 Jul. 14, 2011

(51) Int. Cl.
*G10D 13/08* (2006.01)

(52) U.S. Cl. ..... 84/403; 84/402; 84/404

(58) Field of Classification Search ..... 84/403
See application file for complete search history.

(56) References Cited

U.S. PATENT DOCUMENTS

| | | | | |
|---|---|---|---|---|
| 1,567,803 | A | 12/1925 | Ludwig | |
| 2,133,911 | A | 10/1938 | Alexander | |
| 2,137,651 | A | 11/1938 | Larrabee | |
| 2,788,697 | A * | 4/1957 | Anthony | 84/404 |
| 3,339,445 | A * | 9/1967 | Fuchs | 84/406 |
| 3,439,572 | A | 4/1969 | Cohen | |
| 3,858,477 | A * | 1/1975 | Kawakami | 84/410 |
| 4,127,053 | A | 11/1978 | Cohen | |
| 4,469,003 | A | 9/1984 | Phelps | |
| 4,658,694 | A | 4/1987 | Marks et al. | |
| 4,901,617 | A | 2/1990 | Malone et al. | |
| 4,909,124 | A * | 3/1990 | Chang | 84/403 |
| 5,007,322 | A | 4/1991 | Morris | |
| 5,177,310 | A * | 1/1993 | Davies | 84/404 |
| D368,110 | S | 3/1996 | Roos | |
| 5,813,899 | A | 9/1998 | Hartley | |
| 5,986,194 | A | 11/1999 | Schwartz et al. | |
| 6,245,978 | B1 * | 6/2001 | Stevens | 84/402 |
| 7,225,753 | B1 * | 6/2007 | Lo | 116/167 |
| 7,281,966 | B2 * | 10/2007 | McQueen | 446/421 |
| 2005/0211060 | A1 * | 9/2005 | Carter | 84/410 |
| 2006/0128265 | A1 | 6/2006 | Steinberg | |

* cited by examiner

*Primary Examiner* — Elvin G Enad
*Assistant Examiner* — Christopher Uhlir
(74) *Attorney, Agent, or Firm* — Hudnell Law Group P.C.

(57) ABSTRACT

A triangle musical instrument that may be played using a single hand. The triangle is formed such that a percussionist is able to grasp the triangle in one hand and shake it in a back-and-forth motion to produce the familiar triangle musical instrument sound. Openings formed in the sides of the instrument allow the percussionist to mute the sounds.

16 Claims, 5 Drawing Sheets

ONE-HANDED MUSICAL TRIANGLE

BACKGROUND

With its ability to project a sonorous tone over almost any musical competition, the triangle has been a staple of the percussionist's arsenal for centuries. In all that time the triangle's design has remained essentially the same: a single steel rod bent into a triangular shape. The triangle is played by holding it in one hand or suspending it from a stand, and striking it with a beater held in the other hand. Performing any sort of creative or complex rhythms generally requires the use of two hands.

SUMMARY

The present invention relates to hand percussion instruments, and more particularly to a triangle capable of being played with one hand. In a first aspect, a percussion instrument comprises a substantially hollow enclosure, a bar, the bar suspended within the enclosure by a suspension assembly, a striker assembly, the striker assembly comprising a striker, the striker capable of striking the bar to produce an audible tone.

Implementations can include all, some, or none of the following features. The striker assembly can comprise a channel, the channel comprising at least one open end adjacent to the bar such that the striker slides within the channel to strike the bar. The enclosure can be substantially triangular. The bar can be substantially V-shaped. The enclosure can comprise a top shell and a bottom shell, the top shell fixedly connected to the bottom shell. The enclosure can comprise at least one aperture such that the bar is exposed. The suspension assembly can comprise a first support member, a second support member, a third support member, a fourth support member, a first string, the first string extending between the first support member and second support member, the first string further being secured to the first support member and the second support member, and a second string, the second string extending between the third support member and the fourth support member, the second string further being secured to the third support member and the forth support member. The bar can comprise at least one first hole at a first end and at least one a second hole at a second end, the first string extends through the first hole and the second string extends through the second hole such that the first end is suspended between the first support member and the second support member and the second end is suspended between the third support member and the fourth support member. The enclosure can be made of a material selected from the group consisting of hard plastic, fiberglass, and a combination of hard plastic and fiberglass. The enclosure can be made of a material selected from the group consisting of ABS, Lexan, and a combination of ABS and Lexan. The enclosure can be made of a material selected from the group consisting of HDPE, metal, and acrylic. The enclosure can be a single injection molded piece. The enclosure can be a single piece of machined material.

In a second aspect, a percussion instrument comprises a substantially hollow enclosure, a first bar and a second bar, the first bar and second bar suspended within the enclosure by a suspension assembly, a striker assembly, the striker assembly comprising a striker, the striker capable of striking the first bar and the second bar to produce an audible tone.

Implementations can include some, all, or none of the following features. The striker assembly can comprise a channel, the channel comprising a first open end adjacent to the first bar and a second open end adjacent to the second bar such that the striker slides within the channel to strike the first bar and the second bar. The striker assembly can comprise a striker support member, the striker support member secured to the enclosure, the striker movably connected to the striker support member such that the striker swings between the first bar and the second bar.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
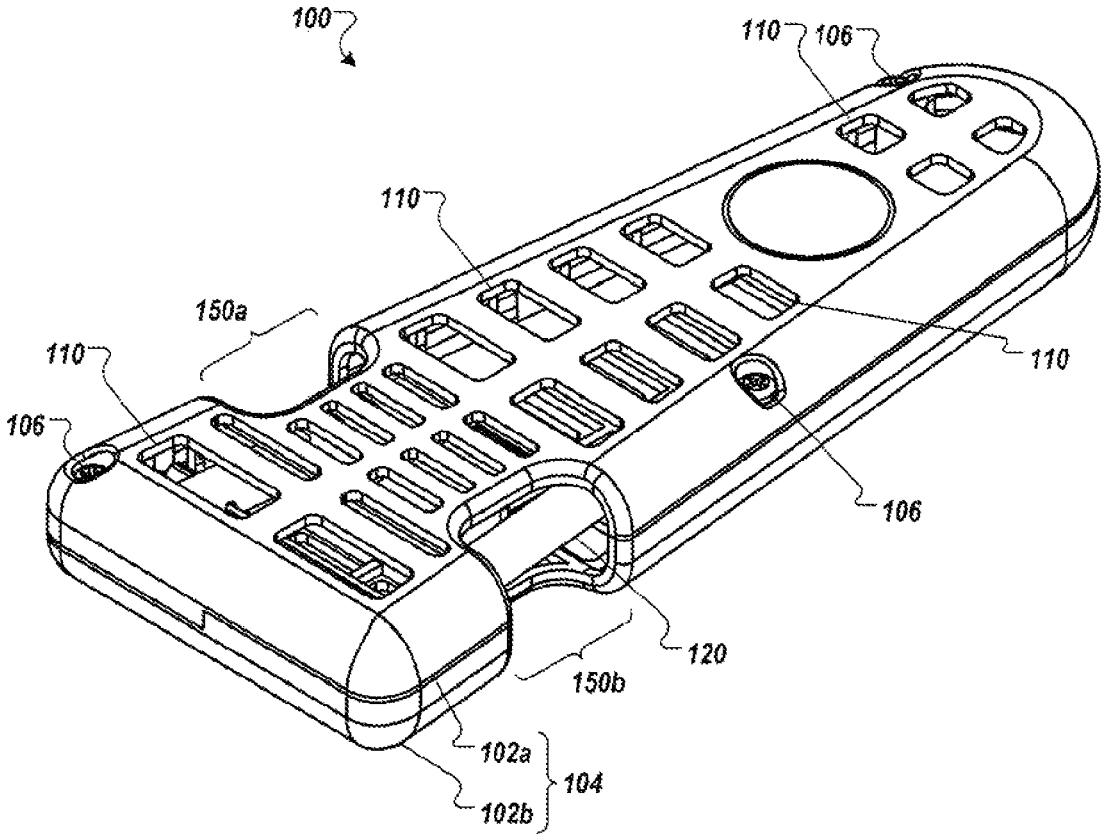
FIG. 1 is a perspective view of an example one-handed musical triangle.
Figure 2:
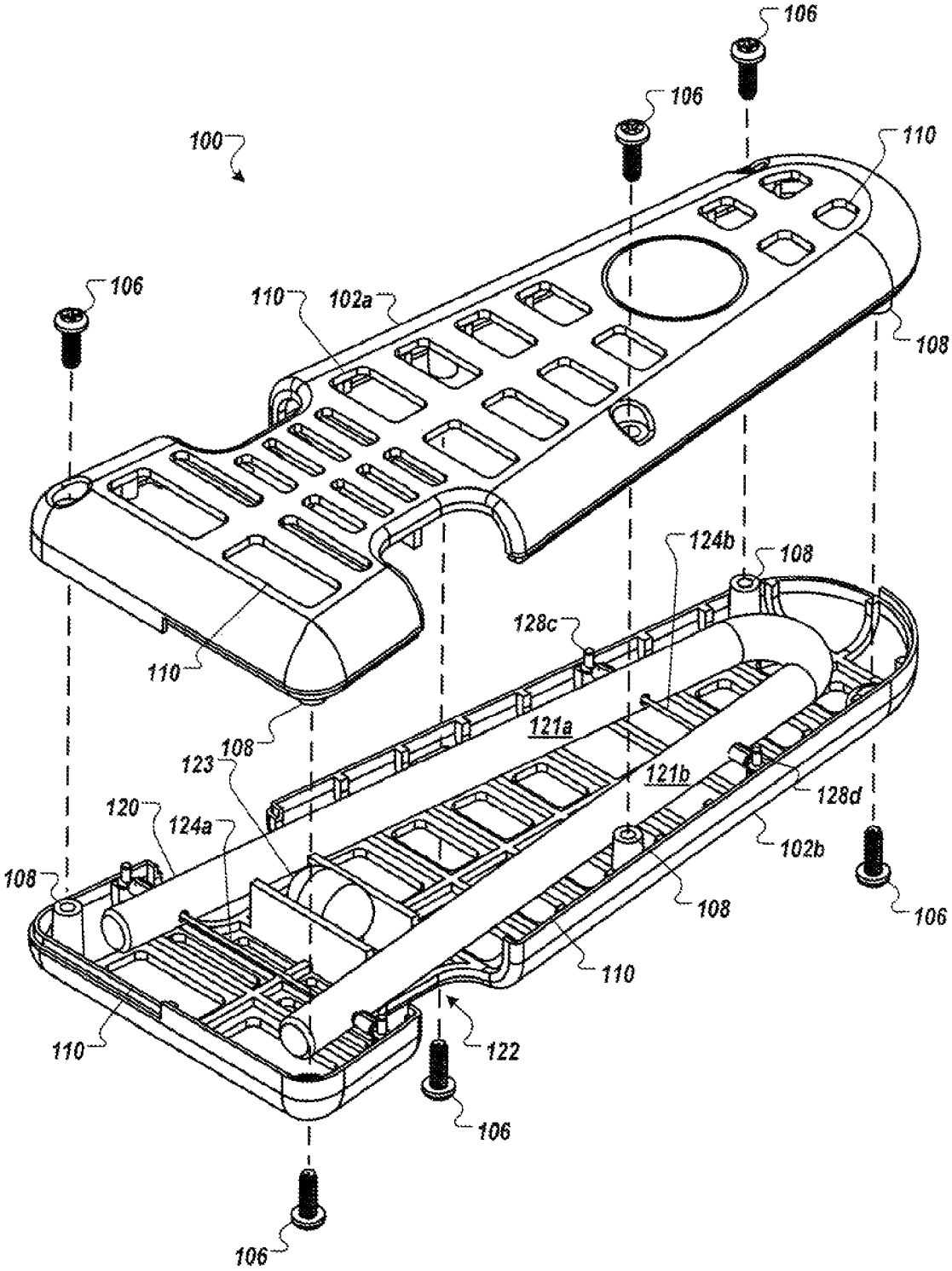
FIG. 2 depicts an exploded view of an example one-handed musical triangle.
Figure 3:
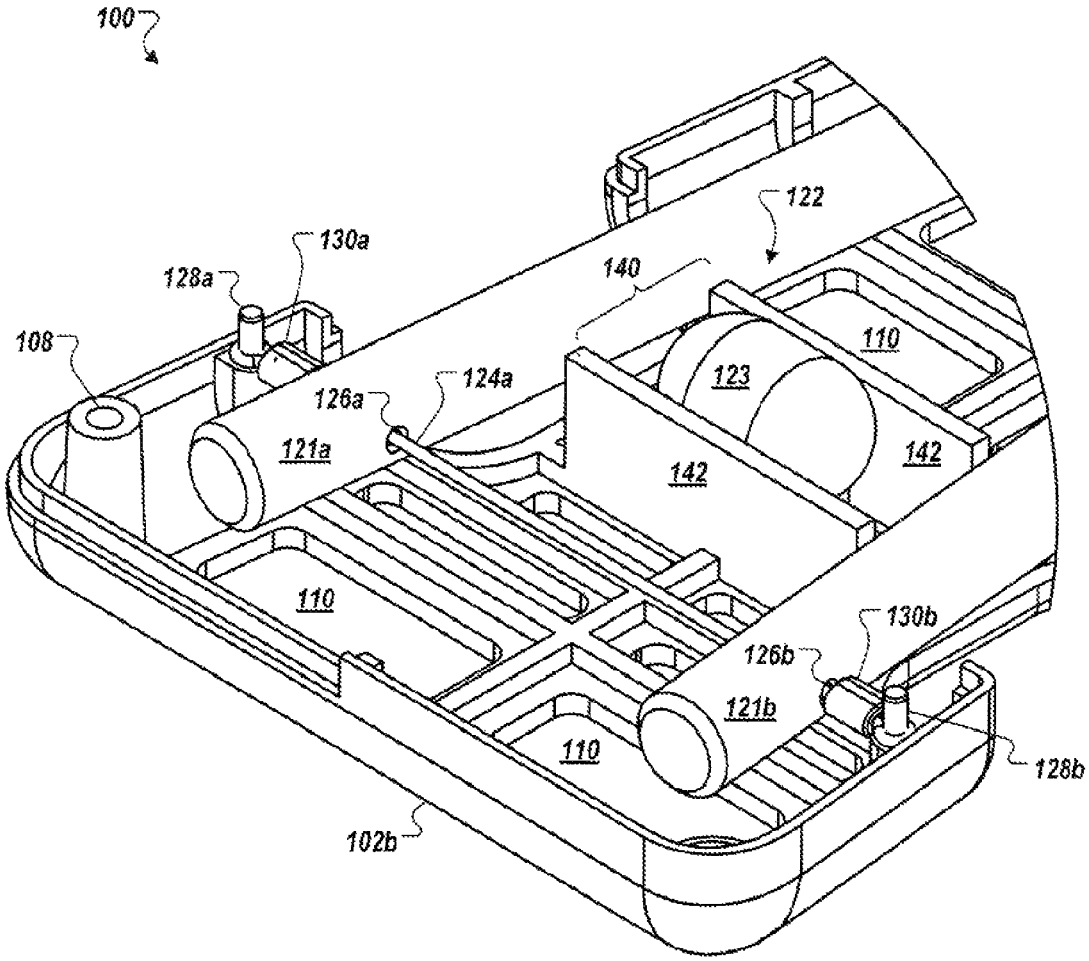
FIG. 3 shows a detailed partial view of the internal construction of an example one-handed musical triangle.

FIGS. 1-3 depict several views of an example triangle 100 musical instrument that may be played using a single hand. Generally speaking, the triangle 100 is formed such that a percussionist is able to grasp the triangle 100 in one hand and shake it in a back-and-forth motion to produce the familiar triangle musical instrument sound.

The triangle includes a top shell section 102*a* and a bottom shell section 102*b* that, when assembled as depicted in FIG. 1, form a substantially hollow enclosure 104. In some embodiments, the top shell section 102*a* and the bottom shell section 102*b* may be held together by a collection of screws 106 that thread into a collection of threaded apertures 108 formed within the shell sections 102*a*-102*b*. In some embodiments, the collection of screws 106 may thread into a collection of nuts to hold the shell sections 102*a*-102*b* together. In other embodiments, the top shell section 102*a* and the bottom shell section 102*b* may include tabs, barbs, flanges, or other sections formed therein that may allow the shell sections 102*a*-102*b* to be assembled by pressing the top shell section 102*a* and the bottom shell section 102*b* together. In yet other embodiments, the substantially hollow enclosure 104 may be formed as a single unit (e.g., by injection molding or machining). In some embodiments, the substantially hollow enclosure 104 may be formed of hard plastic, fiberglass, acrylic, ABS, Lexan, carbon fiber, metal, wood, HDPE or combinations of these and/or other materials.

The substantially hollow enclosure 104 is perforated with a collection of apertures (vents) 110. In some embodiments, the apertures 110 may be sized, shaped, and/or located so that sounds produced within the substantially hollow enclosure 104 emanate to the outside environment.

Referring to the exploded view of FIG. 2 and the partial view of FIG. 3, included within the substantially hollow enclosure 104 is a bar 120 and a striker assembly 122. In some embodiments, the bar 120 may be made of metal, ceramic, glass, wood, plastic, or other material that may be formed into a shape that can resonate with an audible tone when struck by a striker 122. In some embodiments, the bar 120 may be solid or hollow. In some embodiments where the bar 120 is formed of metal, the bar 120 may be heat treated, hardened, coated, anodized, cryogenically treated, or otherwise processed so as to alter the resonant properties of the bar 120 and/or the tone it produces when struck.

In the illustrated example, the bar 120 is bent into a substantially V-shaped formation including two prongs 121*a* and 121*b*. In some embodiments, the bar 120 may be a single straight bar or be formed into shapes having two, three, or more sides. In some embodiments, the bar 120 may be curved. In some embodiments, the bar 120 may comprise two or more bars.

Figure 4:
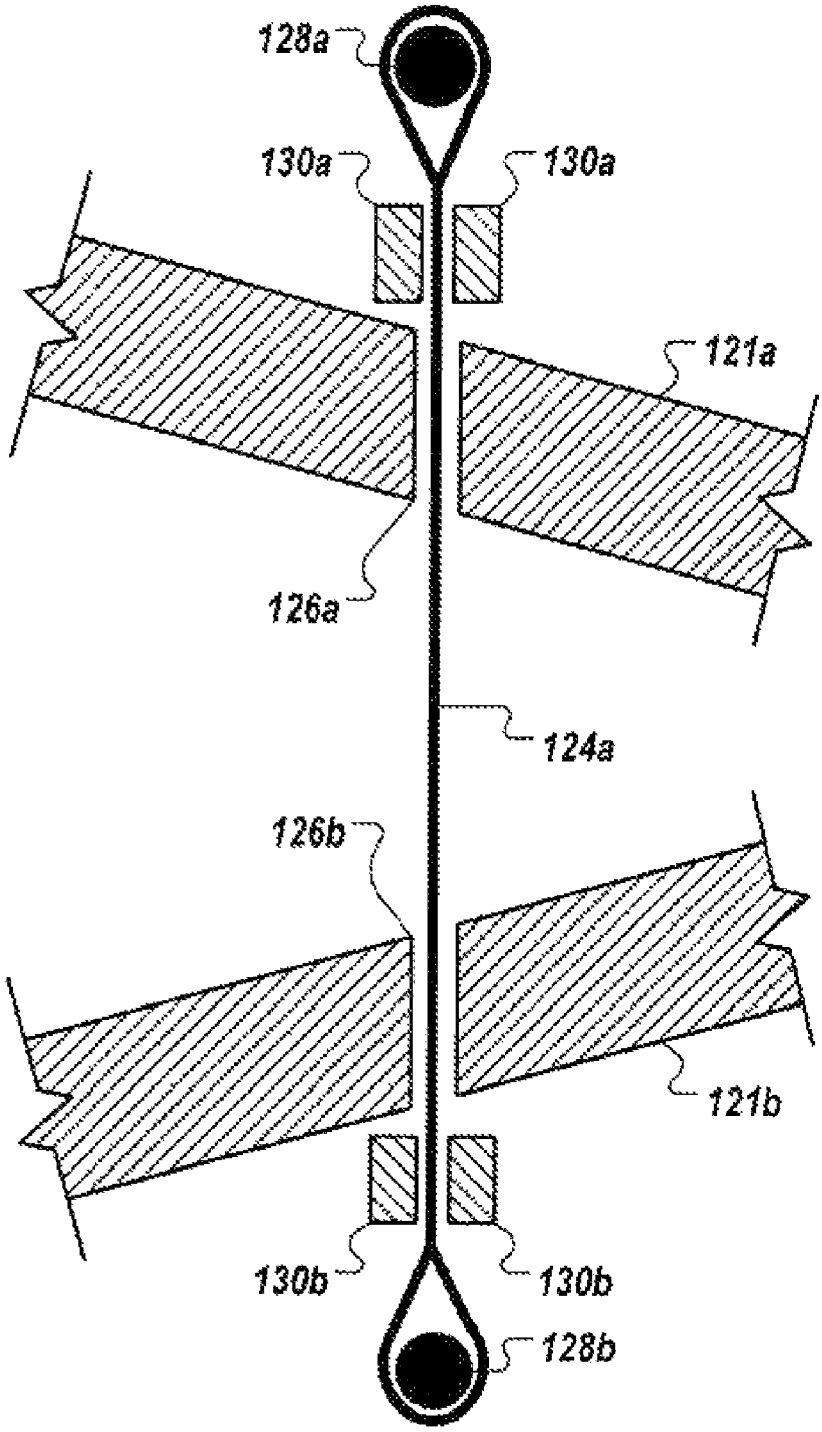
FIG. 4 depicts a cross-sectional view of the suspension assembly.

The bar 120 is suspended within the substantially hollow enclosure 104 by a suspension assembly comprising a string 124*a* and a string 124*b*. FIG. 4 illustrates a cross-sectional view (not to scale) of the suspension assembly, wherein the string 124*a* passes through a hole 126*a* formed in the prong 121*a* and a hole 126*b* formed in the prong 121*b*, with one end of the string is wrapped around or otherwise secured to a support member 128*a* such as a pin or screw, and the other end similarly secured to a support member 128*b*. A spacer 130*a* and a spacer 130*b* are included about the string 124*a* between the prong 121*a* and the support member 128*a*, and between the prong 121*b* and the support member 128*b*, to substantially maintain the bar 120 in a centralized position between the support members 128*a*-128*b*. Likewise, referring again to FIG. 3, the bar 120 is also suspended by a suspension assembly comprising the string 124*b* extending between a support member 128*c* and a support member 128*d*, through holes in the prongs 121*a*-121*b*. In some embodiments, the strings 124*a*-124*b* may be wrapped around the prongs 121*a*-121*b* to suspend and/or maintain the position of the bar 120 within the interior of the substantially hollow enclosure 104. In some embodiments, the strings 124*a*-124*b* may be a braided cord, a metal wire, or a smooth string (e.g., plastic line) that may be substantially elastic or rigid.

The striker 123 is at least partly enclosed in a channel 140. The channel includes a collection of wall sections 142 formed in the top shell section 102*a* and the bottom shell section 102*b*, such that the wall sections 142 form a substantially rectangular or cylindrical tube with open ends when the shell sections 102*a*-102*b* are assembled as depicted in FIG. 1. The open ends of the channel 140 are at least partly blocked by the bar 120, such that the striker 123 is contained within the channel 140, and such that the striker 123 can slidably traverse the channel 140 until coming into contact with the bar 120. In some implementations, the striker 123 can slide through the channel 140 rapidly enough such that the bar 120 will sound a tone when struck by the striker 123. In some implementations, the striker 123 and/or the channel 140 may be provided with a material that promotes the striker's 123 ability to slide within the channel 140. For example, the striker 123 and/or the channel 140 may be coated, wrapped, lined, or otherwise treated with a friction-reducing material, such as Teflon, nylon, ceramic, or other materials with a low coefficient of friction. Such materials may also promote a smooth and quiet operation of the instrument.

In some embodiments, the string 124*a* may pass through a hole in the striker 123, thereby allowing the striker 123 to slide along the string 124*a* between the prongs 121*a* and 121*b*, forgoing the use of the channel 140. In some embodiments, the striker assembly 122 may be a cantilever spring assembly wherein one end may be rigidly connected to the substantially hollow shell 104 and wherein a striker is affixed to the distal end, such that the striker is positioned between the prongs 121*a*-121*b* when at rest, but may made to strike the prongs 121*a*-121*b* when the percussionist shakes the triangle 100 with enough force so as to cause the cantilever spring assembly to bend causing the striker to travel in an arc between the two prongs 121*a*-121*b*.

Figure 5A:
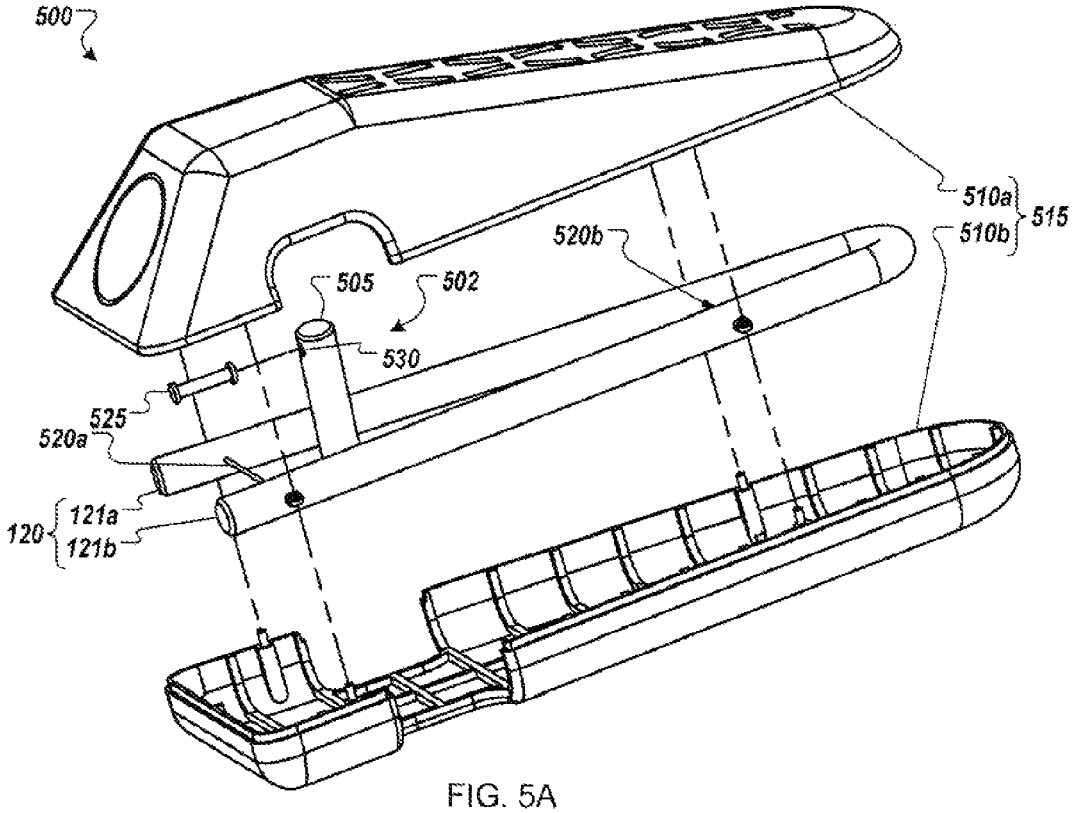
FIG. 5A is an exploded view of an example one-handed musical triangle that includes a pendulum.
Figure 5B:
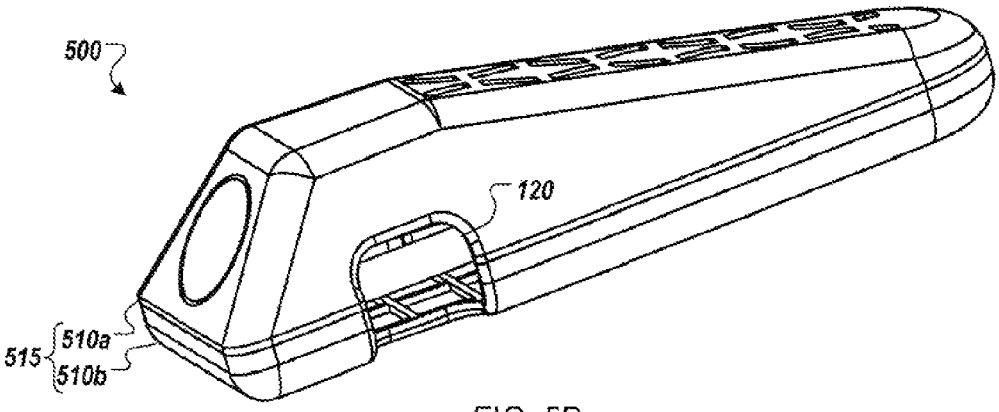
FIG. 5B is a perspective view of the example one-handed musical triangle that includes a pendulum.

FIG. 5A is an exploded view of an example one-handed musical triangle 500 that includes a striker assembly 502. FIG. 5B is a perspective view of the example one-handed musical triangle 500. In general, the one-handed musical triangle 500 is substantially the same as the one-handed musical triangle 100, with an alternative embodiment of the striker 122 and shell sections 102*a*-102*b*. The one-handed musical triangle 500 includes a top shell section 510*a* and a bottom shell section 510*b* that are formed such that the shell sections 510*a*-510*b* can be assembled to form a substantially hollow shell 515. The bar 120 is suspended within the substantially hollow shell 515 by a suspension assembly 520*a* and a suspension assembly 520*b*.

A pendulum 505 is pivotably connected to the upper shell section 510*a* by an axle section 525. The axle section 525 passes through a hole 530 formed in the pendulum 505, and is affixed to the upper shell section 510*a* such that the pendulum 505 swings in a plane substantially intersecting both prongs 121*a*-121*b*. In some implementations, the percussionist may shake the one-handed musical triangle 500 causing the pendulum 505 to swing and strike the prongs 121*a*-121*b*, causing the bar 120 to sound a tone. In some embodiments, the pendulum may be made of metal, plastic, rubber, ceramic, wood, or other material that can be used to strike the bar 120 causing it to vibrate with an audible tone.

The examples described above can form a substantially triangle shaped percussion instrument that may be held in one hand and shaken to produce sounds substantially indistinguishable from those produced by a conventional triangle instrument. It should be noted that the instrument may be modified in various ways to produce other tones and patterns. For example, the bar 120 may be formed as a cylinder to produce a tube bell sound, or the bar 120 may be constructed of wood to produce a xylophone note. In another example, the prongs 121*a*-121*b* may separate members capable of vibrating substantially independently, wherein the prongs 121*a*-121*b* may be formed to resonate two different audible frequencies and/or waveforms.

Referring again to FIG. 1, the substantially hollow shell 104 includes two apertures 150*a* and 150*b*. In some embodiments, the apertures 150*a* and 150*b* expose the bar 120 such that the percussionist may touch the bar 120. For example, the percussionist may grip the triangle 100 such that one or more fingers may pass into the apertures 150*a*-150*b* and contact the bar 120 to selectably dampen vibrations of the bar 120. As such, the percussionist may have a increased palette of tones that may be produced while playing the triangle 100 with only one hand. For example, the percussionist may allow the bar 120 to ring, mute a ringing note, prevent a note from being produced, strike a dampened note, or produce other tones by selectably shaking and muting the triangle 100. By having apertures on both sides of the triangle, the design allows the percussionist to dampen the sound of the instrument regardless of how it is held in the hand.

A number of embodiments of the invention have been described. Nevertheless, it will be understood that various modifications may be made without departing from the spirit and scope of the invention. Accordingly, other embodiments are within the scope of the following claims.

What is claimed is:

1. A hand-held percussion instrument comprising:

a substantially hollow enclosure;

a bar, the bar comprising at least a first prong and a second prong, the bar suspended within the enclosure by a suspension assembly;

a channel, a striker, the striker capable of striking the first prong and the second prong to produce an audible tone; wherein the channel is disposed between the first prong and the second prong, the channel comprising a first open end adjacent to the first prong and a second open end adjacent to the second prong such that the striker slides within the channel to strike the bar.

2. The hand-held percussion instrument of claim 1, wherein the enclosure is substantially triangular.

3. The hand-held percussion instrument of claim 1, wherein the bar is substantially V-shaped.

4. The hand-held percussion instrument of claim 1 wherein in the enclosure comprises a top shell and a bottom shell, the top shell fixedly connected to the bottom shell.

5. The hand-held percussion instrument of claim 1, wherein the enclosure comprises at least one aperture such that the bar is exposed.

6. The hand-held percussion instrument of claim 1, wherein the suspension assembly comprises:

a first support member;

a second support member;

a third support member;

a fourth support member;

a first string, the first string extending between the first support member and second support member, the first string further being secured to the first support member and the second support member; and a second string, the second string extending between the third support member and the fourth support member, the second string further being secured to the third support member and the fourth support member.

7. The hand-held percussion instrument of claim of 6, wherein the bar comprises at least one first hole at a first end and at least one a second hole at a second end, the first string extends through the first hole and the second string extends through the second hole such that the first end is suspended between the first support member and the second support member and the second end is suspended between the third support member and the fourth support member.

8. The hand-held percussion instrument of claim 1, wherein the enclosure is made of a material selected from the group consisting of hard plastic, fiberglass, and a combination of hard plastic and fiberglass.

9. The hand-held percussion instrument of claim 1, wherein the enclosure is made of a material selected from the group consisting of ABS, Lexan, and a combination of ABS and Lexan.

10. The hand-held percussion instrument of claim 1, wherein the enclosure is made of a material selected from the group consisting of HDPE, metal, and acrylic.

11. The hand-held percussion instrument of claim 1, wherein the enclosure is a single injection molded piece.

12. The hand-held percussion instrument of claim 1, wherein the enclosure is a single piece of machined material.

13. The hand-held percussion instrument of claim 1 wherein the striker is disposed between the first prong and the second prong.

14. The hand-held percussion instrument of claim 1 wherein the striker comprises a friction-reducing coating.

15. A hand-held percussion instrument comprising:

a substantially hollow enclosure;

a first bar and a second bar, the first bar and second bar suspended within the enclosure by a suspension assembly, the enclosure comprising at least one aperture formed in the enclosure exposing a portion of at least one of the first bar and the second bar, the exposed portion of the bar is within the enclosure;

a striker assembly, the striker assembly comprising:

a striker, the striker capable of striking the first bar and the second bar to produce an audible tone; and a channel member, the channel member comprising a first open end adjacent to the first bar and a second open end adjacent to the second bar such that the striker slides within the channel member to strike the first bar and the second bar.

16. The hand-held percussion instrument of claim 15, wherein the striker assembly comprises an axle, the axle secured to the enclosure, the striker pivotably connected to the axle such that the striker swings between the first bar and the second bar.

* * * * *